US005890324A

United States Patent [19]

Maanum

[11] Patent Number: 5,890,324

[45] Date of Patent: Apr. 6, 1999

[54] ROOF-MOUNTED ARRANGEMENT FOR MELTING SNOW; AND, METHOD

[76] Inventor: Armand D. Maanum, 2300 Douglas Dr. N., Minneapolis, Minn. 55422

[21] Appl. No.: 911,565

[22] Filed: Aug. 14, 1997

[51] Int. Cl.[6] ..... E04D 13/10

[52] U.S. Cl. ..... 52/24; 52/26; 248/237

[58] Field of Search ..... 52/21, 24–26, 52/11, 101; 248/237

[56] References Cited

U.S. PATENT DOCUMENTS

| | | | |
|---|---|---|---|
| 956,647 | 5/1910 | Salls et al. | 52/247 |
| 1,530,233 | 3/1925 | Campbell | 52/24 |
| 4,432,341 | 2/1984 | Howe et al. | 52/11 X |
| 5,570,557 | 11/1996 | Kwiatkowski et al. | 52/26 X |
| 5,664,374 | 9/1997 | Lee | 52/24 |

*Primary Examiner*—Carl D. Friedman
*Assistant Examiner*—Winnie G. Yip
*Attorney, Agent, or Firm*—Merchant, Gould, Smith, Edell, Welter & Schmidt, P.A.

[57] ABSTRACT

A structure for positioning on a roof to retard snow or ice accumulation thereon is provided. The structure generally comprises an elongate fin arrangement including a central vane. The central vane comprises a material which will absorb solar energy and radiate heat, to inhibit snow buildup around the structure. The elongate fin arrangement optionally comprises an upper vane structure, and a lower cover. A combination comprising a structure as described, and a roof surface, is presented. Methods of assembly and use are also provided.

18 Claims, 3 Drawing Sheets

ROOF-MOUNTED ARRANGEMENT FOR MELTING SNOW; AND, METHOD

FIELD OF THE INVENTION

The present invention relates to methods and structures for inhibiting snow and ice build-up on roofs, especially slanted roofs. The structures generally concern provision of a preferred vane or fin assembly, heated, at least in part, through solar energy. Methods for installation and use are described.

BACKGROUND OF THE INVENTION

Snow and ice build-up on slanted roofs, in northern climates, can be a significant problem. It is often difficult, dangerous, or unacceptable due to weather conditions, to try to climb onto the roofs to remove the snow using brushes or shovels.

SUMMARY OF THE INVENTION

According to the present invention, a structure for positioning on a roof to retard snow accumulation thereon is provided. In this context, the term "retard" is meant to refer to an arrangement which can operate to inhibit build-up of snow and ice, and/or to conveniently melt snow and ice that may be present.

According to the present invention, the structure comprises an elongate fin arrangement. The elongate fin arrangement includes a central vane. The central vane preferably comprises a material which becomes warm when exposed to sunlight and which will radiate heat. Preferably, it is a material which will absorb heat well, and radiate it slowly but efficiently to a surrounding area. Preferred such materials are metals or metal composites. Examples include sheet steel or aluminum. Preferably the material is black or is painted or otherwise coated in black.

The preferred central vane defines a central chamber thereunder. Preferably there is an opening for airflow communication with the central chamber, so that air can freely move in and out of the central chamber. Preferably an opening is at an end of the fin arrangement, most preferably there are openings at both ends of the fin arrangement.

When the intended use is for a roof surface which is uneven, the preferred arrangement includes a bottom cover positioned underneath the vane, to close a portion of the bottom side of the central chamber.

Preferably the arrangement (with or without the bottom cover) includes a nose section defining a covered volume with an open bottom. The nose section, in use, is oriented to project beyond a roof edge.

The preferred central vane is generally inverted "v" in cross-section. The preferred nose section also has a generally inverted "V" cross-section (two sides of a triangle), and in top plan view has a generally triangular outer perimeter. Preferably an apex in the nose section is oriented in a portion of the structure which projects beyond the roof edge, in use; and, a base of the nose section has a triangular perimeter when the nose section is viewed in top plan view.

Preferably the central vane includes opposite outwardly projecting base panels oriented to engage the roof (or the bottom cover if used).

Typical and preferred arrangements according to the present invention have central vanes which are at least 6 feet (about 183 cm) long (typically 8 feet long; i.e. about 245 cm). Preferably the internal central chamber (inverted "V" configuration in cross-section) is configured to have a bottom (distance between widest part of inverted "V") which is at least 8 inches (about 20 cm) wide (for 8 foot long or 245 cm long version; proportionally shorter if less than 8 feet long). In preferred arrangements, the bottom of the center chamber tapers downwardly or narrows in extension from a portion of the arrangement adjacent to roof edge to a portion most distant therefrom but over the roof, when the arrangement is positioned for use, In the preferred version (8 feet or about 245 cm long) the bottom tapers from 8 inches (about 20 cm) down to 4 inches (about 10 cm) wide.

For preferred embodiments, preferably the vane structure is proportioned such that in cross-section it defines an equilateral triangle. Thus, at the widest portion, near the roof edge, the 8 foot long (or 245 cm) version would have an 8 inch (about 20 cm) wide base (gap or space) and 8 inch wide (about 20 cm) sides; and, at the narrow, uppermost end (when mounted on a roof) it would have a 4 inch wide (about 10 cm) base (gap or space) with 4 inch wide (about 10 cm) sides.

Preferably the arrangement includes foot portions extending therefrom in a direction of projection analogous to that of the nose section. The foot portions or feet are preferably arranged to support the nose section in projection over (and typically beyond) a roof gutter, in use.

According to the present invention, a combination of a roof and a structure as described herein is provided. Also methods of assembly and use are provided.

BRIEF DESCRIPTION OF THE DRAWINGS

in FIG. 5 an optional bottom cover being shown in phantom; and, FIG. 6 is a cross-sectional view taken generally along line 6—6, FIG. 5; with an optional bottom cover shown in phantom.

DETAILED DESCRIPTION

The present invention concerns methods and arrangements for facilitating removal of snow and ice from roofs (or inhibiting snow and ice build-up). In connection with the present review of the general principles of the present invention, attention is first directed to FIGS. 1 and 2.

Figure 1:
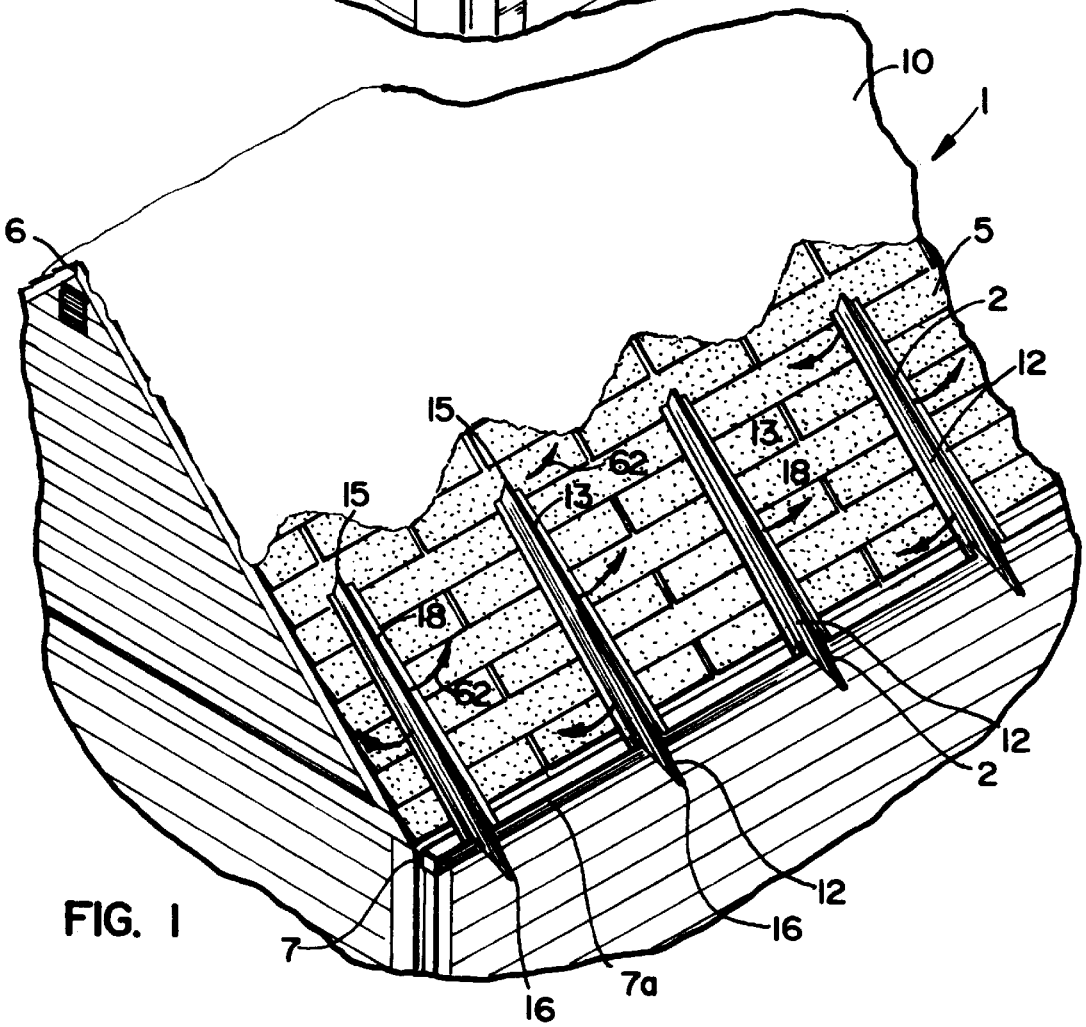
FIG. 1 is a fragmentary perspective view of a roof section having a plurality of structures for melting snow, according to the present invention, mounted thereon.

Referring to FIG. 1, reference numeral 1 depicts a building having installed thereon arrangements or structures 2 for melting snow, according to the present invention.

Referring to FIG. 1, building 1 has a slanted upper roof 5. Upper roof 5 slants downwardly from apex 6 to lower edge 7 (lined by gutter 7*a*). In FIG. 1, snow 10 is shown on the roof 5.

Still referring to FIG. 1, structures 2 each comprise an elongate, fin structure 12. The elongate, fin structures 12 generally comprise preferred materials as described herein below. Each fin structure 12 operates: (a) as a heat trap which will become warm as a result of exposure to sunlight (solar energy); and (b) as a radiator which will radiate heat to a surrounding roof area, facilitating melting of snow and ice thereon and/or inhibiting (retarding) undesirable buildup of snow and ice.

In general, fin structures 12 can be constructed in a variety of lengths. For typical operations, it is foreseen that they will have lengths of about 4 feet (about 122 cm) to 8 feet (about 245 cm), for use with conventional roof styles.

Especially when constructed from preferred materials as described herein below, fin structures 12 according to the present invention will, on sunny days in many climates, have an effective "lateral reach" of about 2 to 3 feet (about 60–90 cm). The term "lateral reach" in this context, is meant to refer to the lateral distance from a fin structure 12 that sufficient heat will typically be radiated to facilitate removal of snow or ice. Operative limitations concern both climate and sunlight limitations, as well as structural limitations. For the characterization of an effective "lateral reach" of about 2 to 3 feet (60–90 cm), it was assumed that not only are the arrangements constructed of the preferred materials described herein below, and in the preferred sizes characterized below, but they are applied on a roof surface which faces the sun and which is located where, in the winter, sunny days with air temperatures of about −10° F. to 32° F. (−23° to 0° C.) are normally, or at least occasionally, reached.

It is noted that while the arrangements could be constructed to facilitate melting of snow during sunny days in which the temperature is not as high as −10° F. (−23° C.), typically ice dam problems and similar melting problems are not encountered on such days. What is of greatest importance, then, is that ice dam problems and similar problems are avoided on −10° F. to 32° F. (−23° to 0° C.) days.

Still referring to FIG. 1, each fin structure 12 comprises a central vane 13 having an upper end 15 and lower end 16, with ridge 18 extending therebetween.

Figure 3:
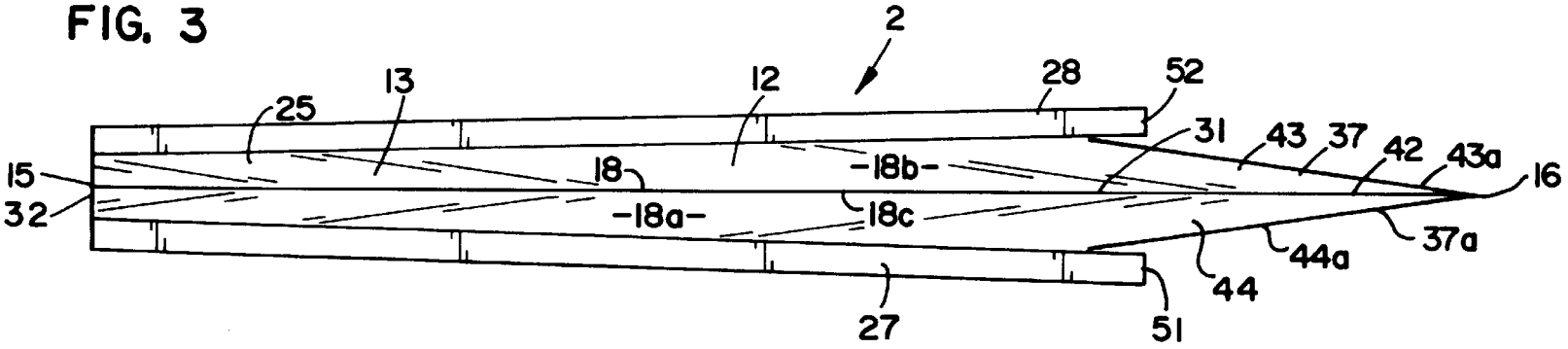
FIG. 3 is a top plan view of a structure according to the present invention.
Figure 4:
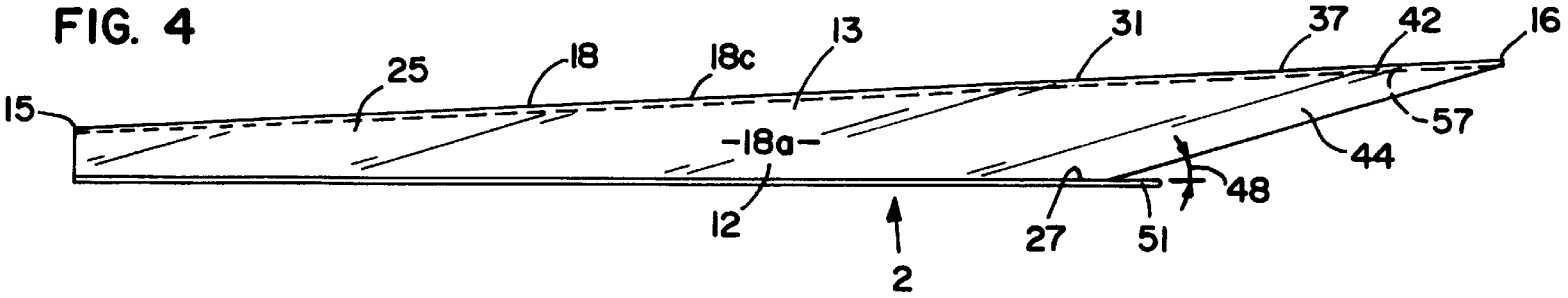
FIG. 4 is a side elevational view of the structure shown in FIG. 3.
Figure 5:
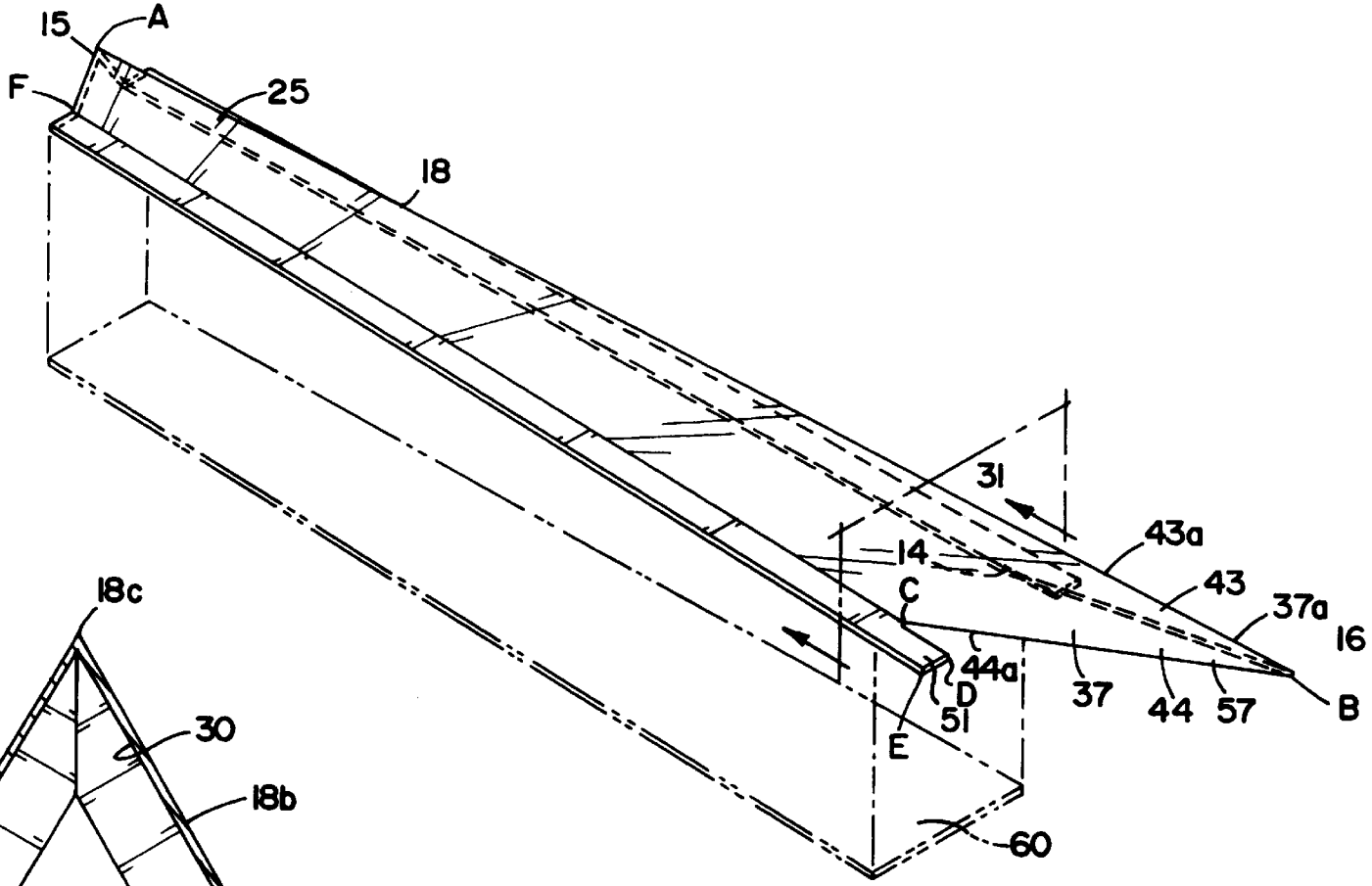
FIG. 5 is a perspective view of the structure shown in FIGS. 3 and 4.

Attention is now directed to FIGS. 3–6. Referring particularly to FIGS. 3, 4 and 5, each fin structure 12 of the preferred embodiment has an upper or cover section 25. The cover section 25 comprises vane 18 and first and second side or base panels 27, 28.

The preferred vane 18 is defined by sidewalls 18*a* and 18*b* forming apex 18*c*. Underneath vane 18, an interior chamber 30 is defined, FIG. 6. As a result of the preferred configuration of vane 18, chamber 30 has a generally triangular or inverted "V" shaped cross-section, (disregarding side extensions) FIG. 6, with opposite side walls 18*a* and 18*b* and a gap or space defined along the bottom. Note that the width and height of triangular vane 18 both taper downwardly, in extension from region 31, FIG. 3, to end 32. Preferred tapers are defined herein below. Region 31 is a point of greatest width of vane structure 18, and is typically oriented at a location on structure 12 which would generally be positioned aligned with (generally positioned directly over or within a few inches of) a lower roof edge 7, FIGS. 1 and 2, in use.

Referring to FIGS. 3, 4, 5 and 6, preferably vane 18 is configured such that throughout its length, between ends 15 and 16, a cross section through sidewalls 18*a* and 18*b*, (analogous in view to the cross section of FIG. 6), reflects or defines an equilateral triangle (disregarding side extensions) defined by walls 18*a*, 18*b* and the open bottom (gap or space) at 33. Thus, preferably the taper is even between region 31 and end 32. Also, preferably it is even between region 31 and tip 16.

Referring again to FIGS. 3–5, the fin structure 12 includes a nose section 37 thereon. The nose section 37 also has a generally triangular or inverted "V" cross-section, in this instance tapering from region 31 to tip 16. In the preferred embodiment shown, nose section 37 has a triangular outer perimeter 37*a*, when viewed in top plan view, FIG. 3. As can be seen from FIGS. 3 and 4, nose section 37 is defined by center ridge 42 and first and second side panels 43 and 44 with edges 43*a* and 44*a*. Referring to FIG. 4, it can be seen that the side edges 43*a* (see FIG. 3) and 44*a* extend upwardly from the base panels 27 and 28, i.e., region 31, to tip 40. Preferably the angle between edges 43*a* and 44*a*, and a plane of side panels 27 and 28, in projection, is within the range of about 14 to 21°, more preferably 15° to 20°, and most preferably about 17° to 18°. The term "in projection" in this context, when used to refer to the angle, is meant to refer to the apparent angle when viewed in side elevation, as shown in FIG. 4 at 48. That is, the angle defined is the projected angle, not the actual angle (which would take into account the fact that edge 44, in FIG. 4, tapers away from the viewer, in extension between region 31 and tip 16).

The purpose of angle 48 is to provide that edges 44*a* and 43*a*, FIG. 3, extend generally horizontally, when the arrangement 12 is mounted on a slanted roof 5, FIG. 1. Thus, angle 48, FIG. 4, will generally correspond to the angle of inclination of the roof 5. The preferred angles stated were based upon typical roof angles for modern houses.

Referring to FIGS. 3 and 5, panels 27 and 28 define end feet 51 and 52, respectively, on opposite sides of nose section 37. An underside 57 of nose section 37 is open, for passage of air into interior 30. The feet 51 and 52 extend or project in the same general direction as the nose section 37, outwardly from region 31. The feet 51 and 52, can be used to help secure structure 12 to roof gutter 7*a*.

For example, the feet 51 and 52 can be bent into a roof gutter. Alternatively, they can be secured to the roof gutter by a variety of attachment mechanisms such as wire clamps, etc., not shown.

Figure 2:
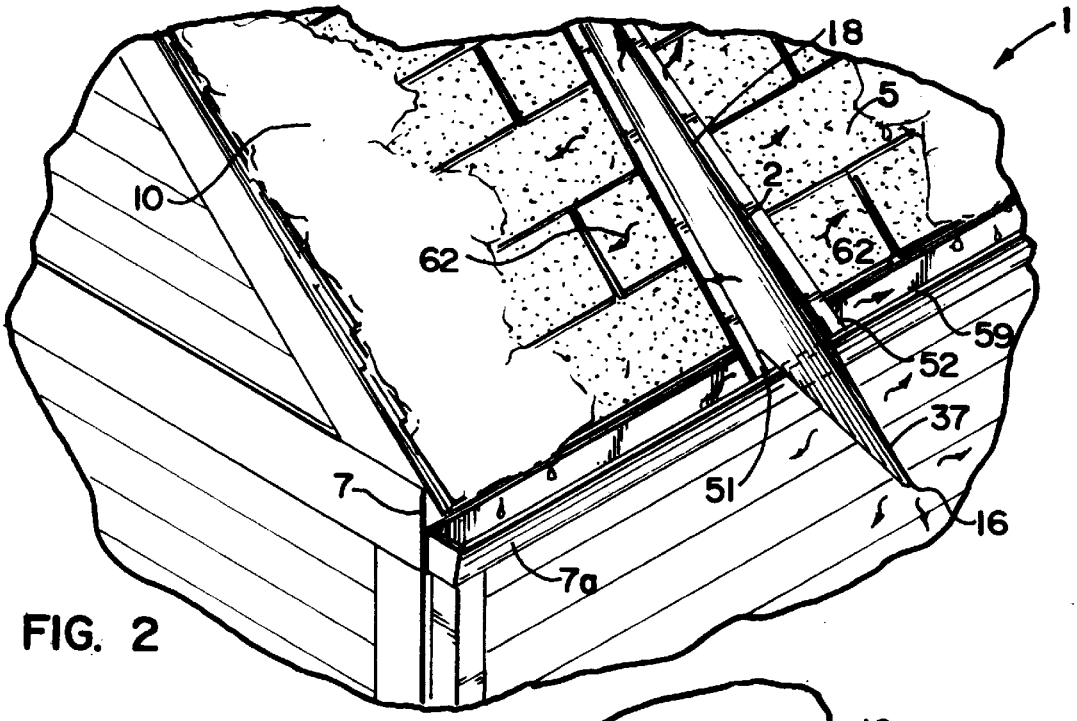
FIG. 2 is an enlarged fragmentary perspective view of a portion of a roof having a structure according to the present invention mounted thereon.

Attention is now directed to FIG. 2. Fin structure 12 is shown mounted on roof 5, with feet 51 and 52 extending across gutter 7*a* (to support nose section 37 over the gutter 7*a* outwardly from roof edge 7) and with nose section 37 extending beyond outer gutter edge 59. As a result, air can freely pass upwardly into nose section 37 and along interior chamber 30 underneath vane 18. That is, nose section 37 has an open underside or bottom 57 in air flow communication with interior chamber 30. Typically, air within region 30 will become warmed by fin structure 12. Preferably nose section 3 is of a size sufficient to project at least 1 foot, (30 cm) and typically at least 1.5 feet (45 cm), beyond the outer gutter edge.

Referring to FIG. 1, in use, fin structure 12 will become warmed by: radiant heat loss from roof 5; and, absorption of solar energy. Fin structure 12 will release the heat (radiate), as indicated by arrows 62, to the immediate surrounding area. This will tend to melt snow and ice from the immediate surrounding area and/or to inhibit (retard) snow and ice build-up. The melt will typically either evaporate or drain downwardly into gutter 7*a*. The configuration of nose section 37 is such that snow and ice is not likely to make its way up into chamber 30, to inhibit operation. Indeed, flow of air in and out of interior chamber 30, along with heating effects as described herein, will tend to keep the interior chamber 30 clear.

Figure 6:
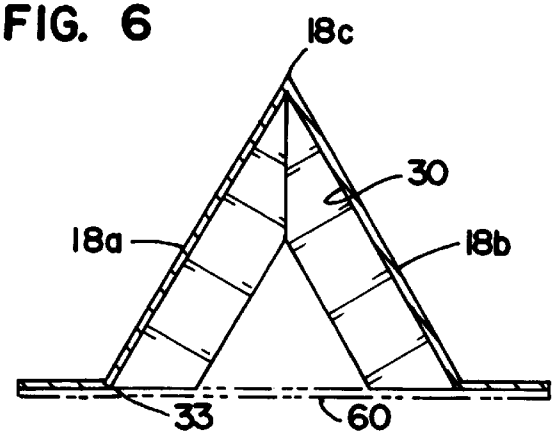

As thus far described, the fin structure 18 is most suitable for use on roof surface which is relatively even. If the surface were relatively uneven, a modification is preferred. In particular, for use with relatively uneven roofs, it may be desirable to provide a bottom cover of selected portions of fin 18. Such an optional bottom cover 60 is indicated in phantom lines in FIGS. 5 and 6. In general, the bottom cover 60 would extend between region 31 and end 15. The bottom cover 60 could be made from a variety of materials including, for example, sheet metal or aluminum. It could be secured to fin 18 by a variety of approaches. Typically, as shown in FIG. 6, it would be secured to side extensions 27 and 28 by adhesive and/or mechanical attachments. In general, it is important that cover 60 not enclose nose section 37, since it is important that nose section 37 remain open for passage of air into interior chamber 30.

It is noted that for the arrangement thus far described, end 15 has not been described as closed. Most preferably end 15 will remain open, through use, facilitating desired movement of air through internal chamber 30.

Principles of construction of arrangements according to the present invention will be further understood by the following description and theory of operation. In general, the structure 12, in preferred configurations as described, is designed to take advantage of the physical principle that moving of heated air in an enclosed duct or tube, that is progressively restricted, will cause the air to radiate the contained heat in progressively increasing amounts. Thus, the selected triangular metal duct configuration, which is also strong, but which is progressively less in cross sectional area in extension from a roof edge upwardly, is desirable. In the preferred embodiment, for an 8 foot long arrangement, an 8 inch by 8 inch by 8 inch (20 cm×20 cm×20 cm) triangular opening at the roof edge 7, tapering progressively smaller to a 4 inch by 4 inch by 4 inch (10 cm×10 cm×10 cm) triangular shape at the opposite end 15, provide the desired advantage.

The preferred use of a black external "color" is also desirable to take advantage of "black body radiation". In general, a black radiator object is one that absorbs electromagnetic radiation. It radiates back heat. Max Plank's formulation for this generation of heat involves calculations for each wave length and, in general, is as follows:

$$Eh = \frac{c_1 h^{-5}}{E^{c_2 / hT - 1}}$$

"E" being the emissive power of "h": the specific wave length of $C_1$ and $C_2$ being numerical values times $10^8$ microwatts per cubic centimeter. The specific figures are not as great of concern here, since the results vary for each wave length calculated and each results in radiation of heat.

A Preferred Construction

A preferred construction is described in this section. From the general principles, a variety of applications will be understood.

The fin structure 12 will be as illustrated in FIG. 5. The bottom plate 60 (if used) will comprise sheet steel or aluminum. The top plate 25 will also comprise sheet steel or aluminum. The top plate 25 will be painted or otherwise colored black.

Assume a roof having a declination angle or pitch of about 17°. An appropriate fin arrangement according to the present invention for such a roof would be as follows:

The total length of the top ridge of cover 25 from point A to point B, FIG. 5, would be about 8 feet (about 245 cm). The total length from point C to point D, FIG. 5, would be about 8 inches (about 20 cm). The width of each of side (base) panels 27 and 28, at its widest point, represented by the distance between points D and E, FIG. 5, would be about 8 inches (about 20 cm) tapering down to about 4 inches (10 cm) at the opposite ends.

The length between points C and F, FIG. 5, would be about 6 feet (about 183 cm).

The distance between points F and A, FIG. 5, would be about 4 inches (about 10 cm). The distance between points C and H, FIGS. 5 and 6, would be about 8 inches (about 20 cm).

Preferably, at any given location, a cross-section through fin 18 (perpendicular to the apex) would generate an equal lateral triangle (except for the side flanges).

The distance between points H and B, i.e., the length of nose section 37 when viewed from the side, would be about 27 inches (about 68 cm). Thus, the nose would project about 20.5 inches (52 cm) beyond a typical 6.5 inch (16.5 cm) wide gutter.

What is claimed is:

1. A structure for positioning on a roof to retard snow and ice accumulation thereon; said structure comprising:

(a) an elongate fin arrangement including a central vane;

(i) said central vane comprising a material which becomes warm when exposed to sunlight and which will radiate heat;

(ii) said central vane defining a central chamber thereunder;

(A) said central chamber comprising an end and a region distal from said end;

(B) said central chamber tapering progressively broader in cross-sectional size from said end to said region distal from said end;

(C) said central vane having a nose section extending outwardly from an upper portion of said central chamber;

(b) said elongate fin arrangement including an opening for air flow communication with said central chamber.

2. A structure according to claim 1 including:

(a) a cover positioned underneath said central vane to enclose at least a portion of a bottom side of said central chamber.

3. A structure according to claim 1 wherein:

(a) said central vane has a generally inverted "V" cross-section in portions defining said central chamber.

4. A structure according to claim 3 wherein:

(a) said central vane includes said nose section defining a covered volume with an open bottom.

5. A structure for positioning on a roof to retard snow and ice accumulation thereon; said structure comprising:

(a) an elongate fin arrangement including a central vane;

(i) said central vane comprising a material which becomes warm when exposed to sunlight and which will radiate heat;

(ii) said central vane defining a central chamber thereunder;

(iii) said central vane having a generally inverted "V" cross-section in portions defining said central chamber;

(iv) said central vane including a nose section defining a covered volume with an open bottom which is;

(A) generally triangular in top plan view; and, (B) has a generally inverted V cross-section; said nose section generally tapering upwardly in cross-sectional size from a tip of said nose section to a portion thereof adjacent a remainder of said central vane;

(b) said elongate fin arrangement including an opening for air flow communication with said central chamber.

6. A structure according to claim 5 wherein:

(a) said central vane includes opposite, outwardly projecting, base panels oriented to engage said bottom cover.

7. A structure according to claim 6 wherein:

(a) said central vane is at least 6 feet long.

8. A structure according to claim 6 wherein:

(a) at a first end, said central chamber has a bottom which is 4 inches wide; and, (b) at a portion adjacent a roof edge in use, said central chamber has a bottom which is 8 inches wide.

9. A structure according to claim 7 including:

(a) first and second feet projecting from respective ones of said base panels and in a general direction of projection of said nose section; said feet being constructed and arranged to support said nose section in projection over a roof gutter.

10. A structure according to claim 9 wherein:

(a) said central vane has a black outer surface.

11. A structure according to claim 10 wherein:

(a) said central vane comprises a material selected from sheet steel and sheet aluminum.

12. A combination comprising:

(a) a building roof having a slanted roof surface and lower edge; and, (b) a structure positioned on said roof, for retarding snow and ice accumulation thereon; said structure comprising:

(i) an elongate fin arrangement including a central vane;

(A) said central vane comprising a material which becomes warm when exposed to sunlight and which will radiate heat;

(B) said central vane defining a central chamber thereunder;

(i) said central chamber comprising a first end and a portion adjacent to a roof edge;

(ii) said central chamber tapering progressively larger in cross-sectional size from said first end to said portion adjacent to a roof edge;

(C) said central vane having a nose section extending outwardly from an upper portion of said central chamber, (ii) said elongate fin arrangement including an opening for air flow communication with said central chamber; and (iii) said elongate fin arrangement including means for securing said structure on said building roof.

13. A combination according to claim 12 including:

(a) a cover positioned underneath said central vane to enclose at least a portion of a bottom side of said central chamber.

14. A combination according to claim 12 wherein:

(a) said central vane has a generally triangular cross-section in portions defining said central chamber.

15. A combination according to claim 14 wherein:

(a) said central vane includes said nose section defining a covered volume with an open bottom.

16. A combination according to claim 15 wherein:

(a) said central vane includes opposite, outwardly projecting, base panels.

17. A combination according to claim 16 wherein:

(a) said central vane is at least 6 feet long.

18. A combination according to claim 17 wherein:

(a) at a first end, said central chamber has a bottom which is 4 inches wide; and, (b) at a portion adjacent to a roof edge, said central chamber has a bottom which is 8 inches wide.

* * * * *